United States Patent [19]

Tippetts

[11] Patent Number: 4,479,515

[45] Date of Patent: Oct. 30, 1984

[54] FLUIDIC CONTROL DEVICES

[75] Inventor: John R. Tippetts, Sheffield, England

[73] Assignee: United Kingdom Atomic Energy Authority, London, England

[21] Appl. No.: 279,622

[22] Filed: Jul. 1, 1981

Related U.S. Application Data

[63] Continuation of Ser. No. 15,600, Feb. 27, 1979, abandoned.

[51] Int. Cl.[3] ..... F15C 1/20; F15C 1/18

[52] U.S. Cl. ..... 137/824; 137/842

[58] Field of Search ..... 137/824, 842

[56] References Cited

U.S. PATENT DOCUMENTS

| | | | |
|---|---|---|---|
| 3,272,215 | 9/1966 | Bjornsen et al. | 137/824 |
| 3,388,713 | 6/1968 | Bjornsen | 137/824 |
| 3,405,724 | 10/1968 | Goldschmied | 137/824 |
| 3,426,780 | 2/1969 | Gray | 137/824 |
| 3,469,592 | 9/1969 | Kuczkowski et al. | 137/824 |
| 3,598,135 | 8/1971 | Lederman | 137/824 |
| 3,626,962 | 12/1971 | Atkinson | 137/824 |
| 3,724,476 | 4/1973 | Bader | 137/842 |
| 4,031,870 | 6/1977 | Ozawa | 137/824 |

FOREIGN PATENT DOCUMENTS

| | | |
|---|---|---|
| 1224311 | 3/1971 | United Kingdom . |
| 1432234 | 4/1976 | United Kingdom . |

*Primary Examiner*—A. Michael Chambers

*Attorney, Agent, or Firm*—King, Liles and Schickli

[57] ABSTRACT

A fluidic flow control device includes at least three terminals with two of the terminals being connected to input nozzles opposing each other in axial alignment. An interspace is provided adjacent the point of intersection of the two streams from the nozzles and a radial diffuser is provided encircling the interspace. The third terminal communicates with the radial diffuser. The variable relationship between the flows produced at the nozzles is effective to control the flow at the third terminal. The diffuser is formed by planar faces separated by a constant width gap. The gap opens into an annular plenum to which the third terminal is connected. The entry area to the radial diffuser is sized to be substantially equal to the sum of the areas of the nozzle throats. In one embodiment, a mixer region may be provided between the diffuser and at least one of the nozzles. A fourth terminal acting as a vent may communicate with the mixer region. If desired, a second radial diffuser may be provided and one nozzle throat may be larger than the other. A partition may be provided in the diffuser.

7 Claims, 5 Drawing Figures

12
22b
20b
18b
26
21b
19b
16
25
20a
18a
21a
19a
15
11
22a

FLUIDIC CONTROL DEVICES

This is a continuation of application Ser. No. 15,600 filed Feb. 27, 1979, now abandoned.

FIELD OF THE INVENTION

The present invention relates to fluidic devices by which fluid flow is controlled. By being qualified as "fluidic", such devices achieve control of fluid flow without employing within themselves any moving parts.

DESCRIPTION OF THE PRIOR ART

A two terminal device is typified by a fluidic diode; in this case the flow control is dependent on direction of flow in that a forward flow will encounter low resistance and reverse flow will encounter high resistance, possibly leading to virtual prevention of reverse flow. A multi-terminal device with three or more terminals may achieve an amplifying function; for example, a third terminal may be used to inject a control flow which with much less energy than is present in a mainstream proceding between first and second terminals can vary the flow in the mainstream, the action of the control flow being commonly to assist or oppose the formation in the mainstream of a vortex by which a pressure drop is created. Alternatively the control may depend on the relationship between flows applied respectively at two terminals, the effect of this control being on the conditions at a third terminal. It is with this alternative that the invention is primarily concerned.

SUMMARY OF THE INVENTION

According to the invention there is provided a multi-terminal fluidic flow control device in which two of the terminals communicate respectively with nozzles opposing each other in axial alignment across an interspace and a third terminal communicates with a radial diffuser opening into and encircling the interspace, a variable relationship of the flows at the nozzles being effective to control flow at the third terminal. In so far as out-flow occurs at the third terminal, the outflow fluid will be derived from either or both of the nozzle flows, although possibly not entirely if there is a supplementary supply of fluid to provide augmentation at the third terminal. Inflow results from entrainment in the nozzle jets.

The radial diffuser is of an annular shape, axially short in length; indeed, it is conveniently formed by planar surfaces arranged in the manner of flanges relative to the nozzles with a constant width gap between them, divergence being unnecessary because of the increase of volume solely as a function of radius. The gap preferably opens into a plenum forming the outermost part of the radial diffuser; with a circular peripheral shape of the diffuser, the plenum may be like a toroid.

With the nozzles merging smoothly into the radial diffuser, preferably also with each of the nozzles having a preceding convergent diffusing section of its own, the device will act in combination with a supply producing constant inflow at one nozzle to provide surprisingly, in response to inflow at the other nozzle, a negative resistance characteristic. This characteristic prevails for inflows up to about the aforementioned constant inflow. Consequently, with a relationship between the nozzle flows where both are positive but one exceeds the other, the lesser flow in increasing towards equality will be accompanied by a decrease in the resistance to outflow through the radial diffuser. Such a characteristic lends itself to pressure regulation where a surge is to be relieved at a rate proportional to its magnitude.

Another form of the invention is based on an asymmetric disposition of the nozzles relative to the radial diffuser, the interspace being elongated axially to introduce a mixer region between one of the nozzles and the diffuser. Adjacent this more distant nozzle is a vent which for present purposes is an opening to a sink of passive fluid, whether it be atmospheric or some other (possibly liquid) environment compatible with operation of the device. With a relationship between the nozzle flows where one is operative and the other inoperative, this relationship being reversed in sequence to render each nozzle flow operative in turn, a suction and delivery cycle is produced at the diffuser outlet.

BRIEF DESCRIPTION OF THE DRAWINGS

The invention will be further described with reference to several examples, these being illustrated in the accompanying drawings wherein.

DESCRIPTION OF THE PREFERRED EMBODIMENT

Figure 1:
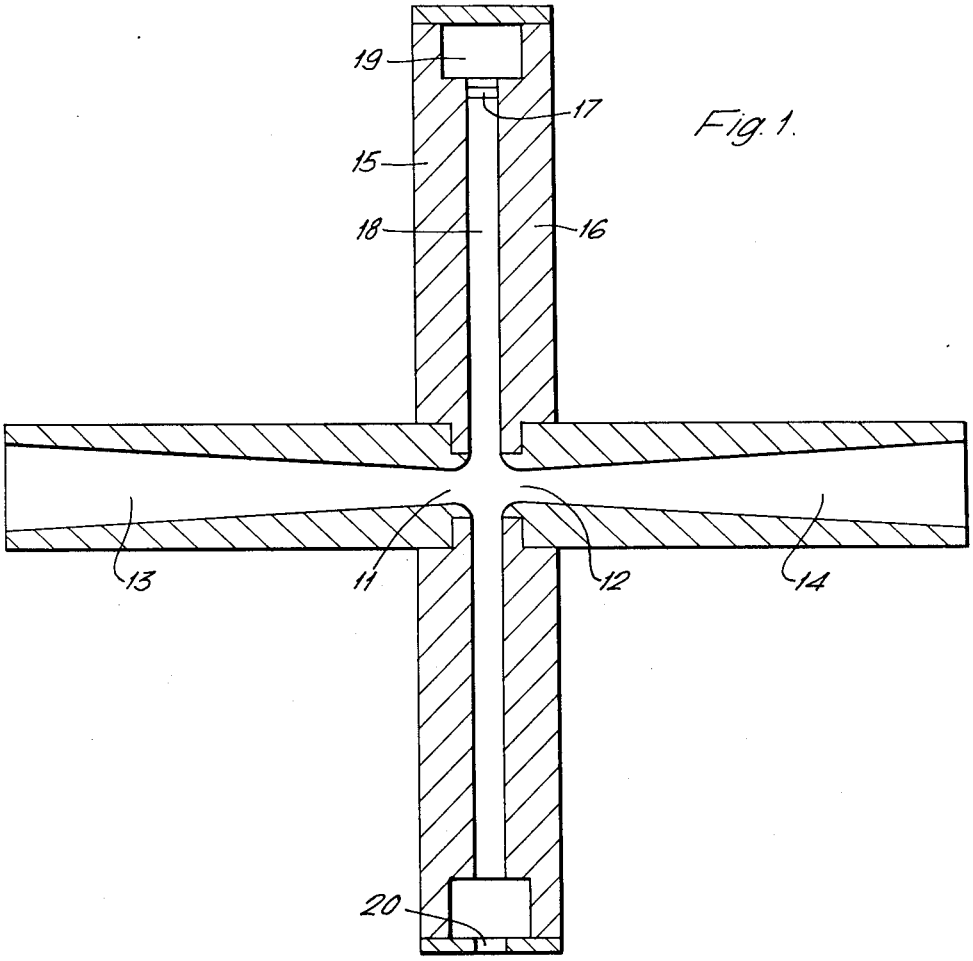
FIG. 1 is an axi-symmetric modulator shown diagrammatically in axial cross-section.

The modulator of FIG. 1 comprises nozzles 11 and 12 opposing each other on a common axis, each nozzle being the termination of a respective conical diffuser 13 and 14. The nozzle ends flare from the throat with a smoothly radiussed curvature to merge with the faces of flanges 15 and 16 which are held separated by a narrow gap by means of a spacer, such as indicated at 17. The gap forms a radial diffuser 18 with the entry thereto located at the point where the curvature of the nozzle ends and the faces of the flanges 15,16 begin. More specifically, in the exemplary embodiment shown in FIG. 1, the entry area into the radial diffuser 18 is defined by an annular area formed between the two rings located at the intersection of the flat faces of flanges 15,16 and the curved terminal ends of the nozzles 11,12. Rebates at the outer margins of the flanges form with an encircling cover a plenum 19 of a shape similar to a toroid and a single connection can be made to this plenum through an aperture 20. Thus there are three terminals, the diffusers 13 and 14 and the aperture 20.

At the region of intercommunication with the interspace between the nozzles the radial diffuser should present an entry area which is at least substantially equal to the sum of the areas of the nozzle throats. For equality the gap width between the faces of the flanges 15 and 16 is 0.254d, where d is the throat diameter, the same for both nozzles. A cone angle of 7° in the diffusers 13 and 14 has been found to achieve good pressure recovery.

The operation of this modulator may be illustrated in its application as a pressure regulator. With a constant pressure fluid supply connected to one of the nozzles, say 11, and with a lesser pressure of fluid at the other two terminals, an inflow through nozzle 11 will proceed through the device to the terminal at lowest pressure which for present purposes will be assumed to be at the radial diffuser outlet aperture 20. The remarkable property of the device is that as the pressure of fluid at the nozzle 12 is caused to increase towards equality with the constant pressure at nozzle 11, the resistance to outflow through the radial diffuser and aperture 20 decreases. Consequently a surge at nozzle 12, within the limit of pressure set by the supply to the nozzle 11, is relieved at a rate to some extent proportional to its magnitude.

In an extractor system for maintaining depression of pressure relative to atmosphere in an enclosure, the constant pressure supply may be atmosphere itself, possibly through a filter, in which case the other nozzle 12 is connected to the enclosure and the aperture 20 to an extractor line. In the event that the depression level in the enclosure ceases to be held because of admission into the enclosure, the extractor line, through the radial diffuser, will be effective to restore the depression to the desired level with resistance diminishing in accordance with the severity of the deviation.

Figure 2:
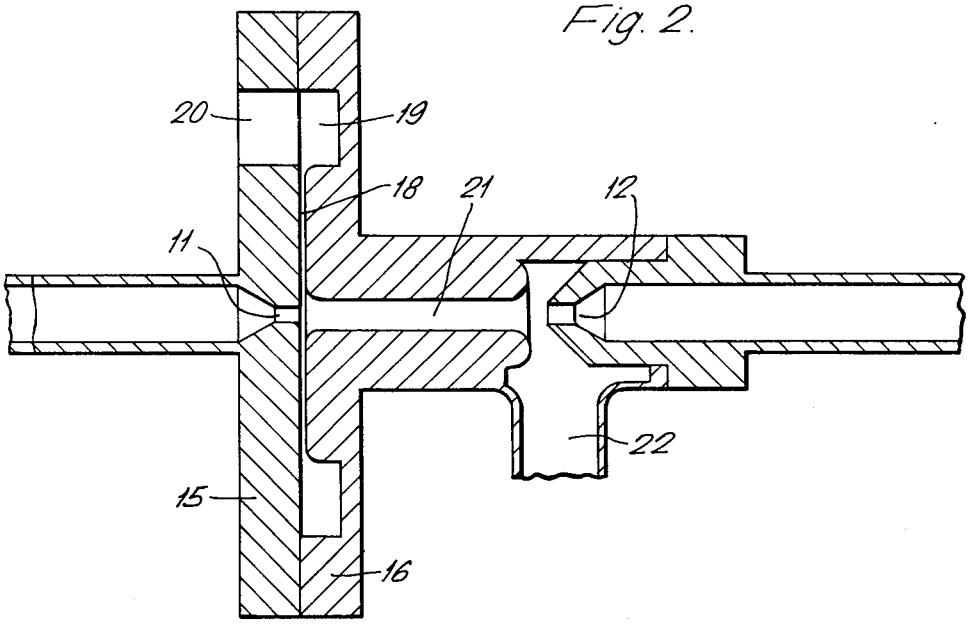
FIG. 2 is a pressure transformer, also shown diagrammatically in axial cross-section

In the pressure transformer of FIG. 2 the nozzle 12 is further removed from the radial diffuser 18. In the extended interspace is a mixer tube 21 and adjacent the nozzle 12 a vent 22. In this embodiment (and similarly in additional embodiments), the entry area into the diffuser 18 is defined by the annular area extending transverse to the diffuser 18 and through the ring located at the intersection of the flat face of the flange and the curved or flared terminal end of the tube 21. Although the mixer tube flares into the radial diffuser with a radiussed curvature, the nozzle 11 opens directly into the interspace, possibly with a relatively sharp edge (as shown). Consequently, with a higher pressure applied at nozzle 11 than prevails at any other of the terminals, a suction effect will be produced at the radial diffuser aperture 20 as a result of the inflow at nozzle 11 and the jet which it forms issuing into the mixer tube. When the relationship of pressure between the nozzles is reversed such that the inflow is at nozzle 12, a blowing or delivery effect will be produced at the aperture 20. Consequently, by alternately pressurising the nozzles 11 and 12, a reciprocating flow is produced at the aperture 20. Expressed alternatively, a pressure differential applied between the terminals represented by nozzles 11 and 12 is converted into amplified differential pressure between the terminals represented by the aperture 20 and the vent 22, a reversal of the first effecting a reversal of the second.

In both states, that of suction and of delivery at the aperture 20, flow from the pressurised nozzle impinges on the passive nozzle and in the received part of this flow a recovery of pressure takes place so that a form of feedback occurs from the passive nozzle, a feature which facilitates operation of the device by bistable fluidic amplifiers. The relatively high feedback pressure diminishes the susceptability of the amplifier to compressability effects occurring at high supply pressures.

A radial diffuser may also be beneficial at the vent 22, especially when the operating pressures are not so high that compression of the fluid detracts from recovery of pressure taking place in such a diffuser. The effect of the diffuser will be in the sense of strengthening the suction phase at aperture 20 by facilitating the vented flow.

For setting up a continuous reciprocating flow, it may be arranged that a constant pressure supply source is connected to the nozzle 11, preferably by way of a pressure adjustment means such as a needle valve. This supply will generate the suction phase and the delivery phase may then be generated by connecting to nozzle 12 a supply source acting intermittently to pressurise the nozzle 12 in excess of the constant pressure at nozzle 11, thereby overcoming the bias inflow through the latter and causing a flow reversal. Such an arrangement readily enables two reciprocating flows to be obtained in anti-phase: two of the devices are needed and through a changeover means, such as a bistable fluidic amplifier, a supply at a pressure sufficiently higher than the bias pressure is connected alternately to the devices.

Figure 3:
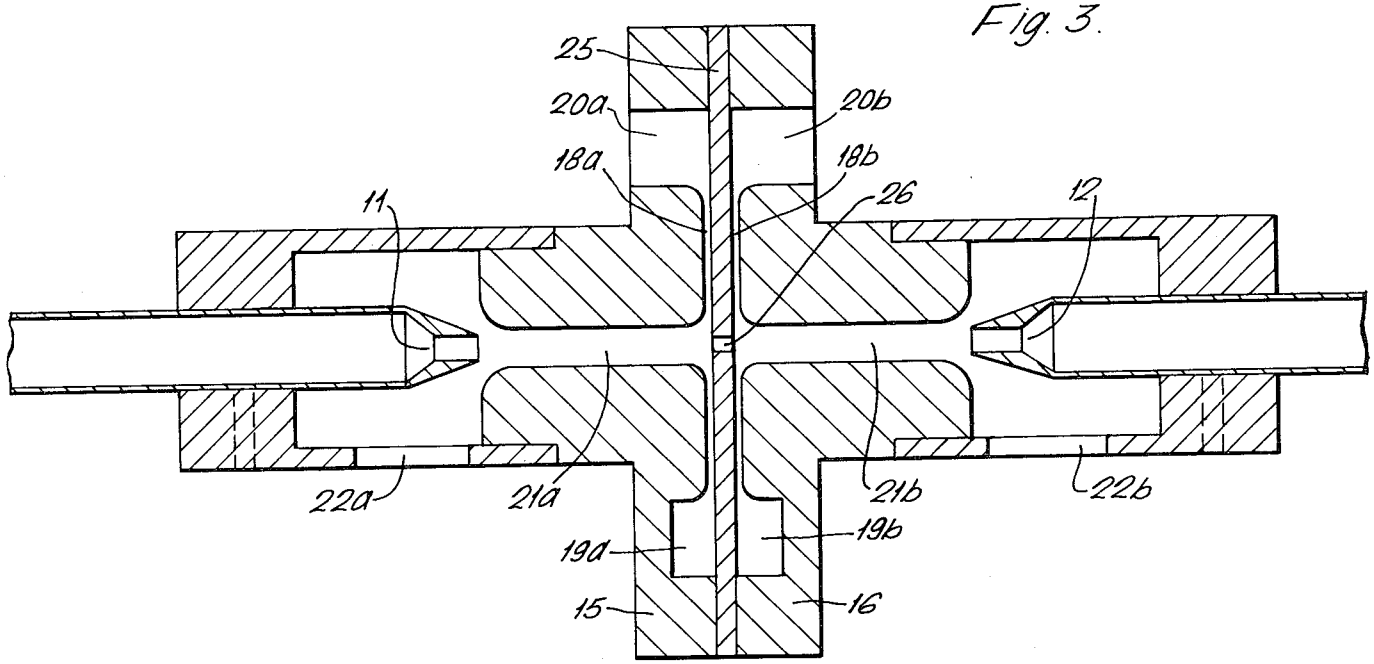
FIG. 3 is a double pressure transformer, again diagrammatically shown in axial cross-section.

Instead of two separate devices for obtaining anti-phase reciprocating flows, a single unit may be provided as illustrated in FIG. 3. Here the flanges 15 and 16 are formed to accommodate an interposed disc 25 in such a way that a radial diffuser **18*a*, 18*b* is formed on either side of the disc, the disc having a sharp edged central orifice 26 co-axial with the nozzles 11 and 12. Mixer tubes 21*a*, 21*b* are also duplicated, being likewise to either side of the orifice 26 and on the same axis. Vents 22*a*, 22*b*, respectively adjacent the nozzles 11 and 12**, may open into further radial diffusers as previously described.

When the high pressure supply feeds nozzle 11, the jet passing into the mixing tube **21*a* gains some static head and is diverted partially into the radial diffuser 18*a* to emerge as a delivery at aperture 20*a*, the remainder passing through the orifice 26 to entrain flow from the radial diffuser 18*b* into the mixing tube 21*b* and thereby produce suction at aperture 20*b*. The flow in the mixing tube 21*b* vents through the vent 22*b* and in doing so a relatively high feedback pressure occurs at nozzle 12 as previously explained. The suction and delivery at the apertures 20*a* and 20*b* is reversed when the high pressure feed is changed from the nozzle 11 to the nozzle 12**.

Many variants of the device as shown in FIG. 3 are within the scope of the invention: The back-to-back arrangement of the radial diffusers **20*a* and 20*b* may be altered by arranging them adjacent the respective nozzles 11 and 12, a mixing tube then extending between them with a single vent at its mid-point, the vent being with or without a radial diffuser. Alternatively, there may be interposed between the radial diffusers 20*a* and 20*b*** a reservoir for augmentation purposes. The augmentation affords a potentially greater output on the suction and delivery phases since considerable driving power can be made available by the inflow to the reservoir or plenum. In addition to the greater power output, the magnitude of the suction phase can be controlled easily by adjustment of the plenum inflow.

Figure 4:
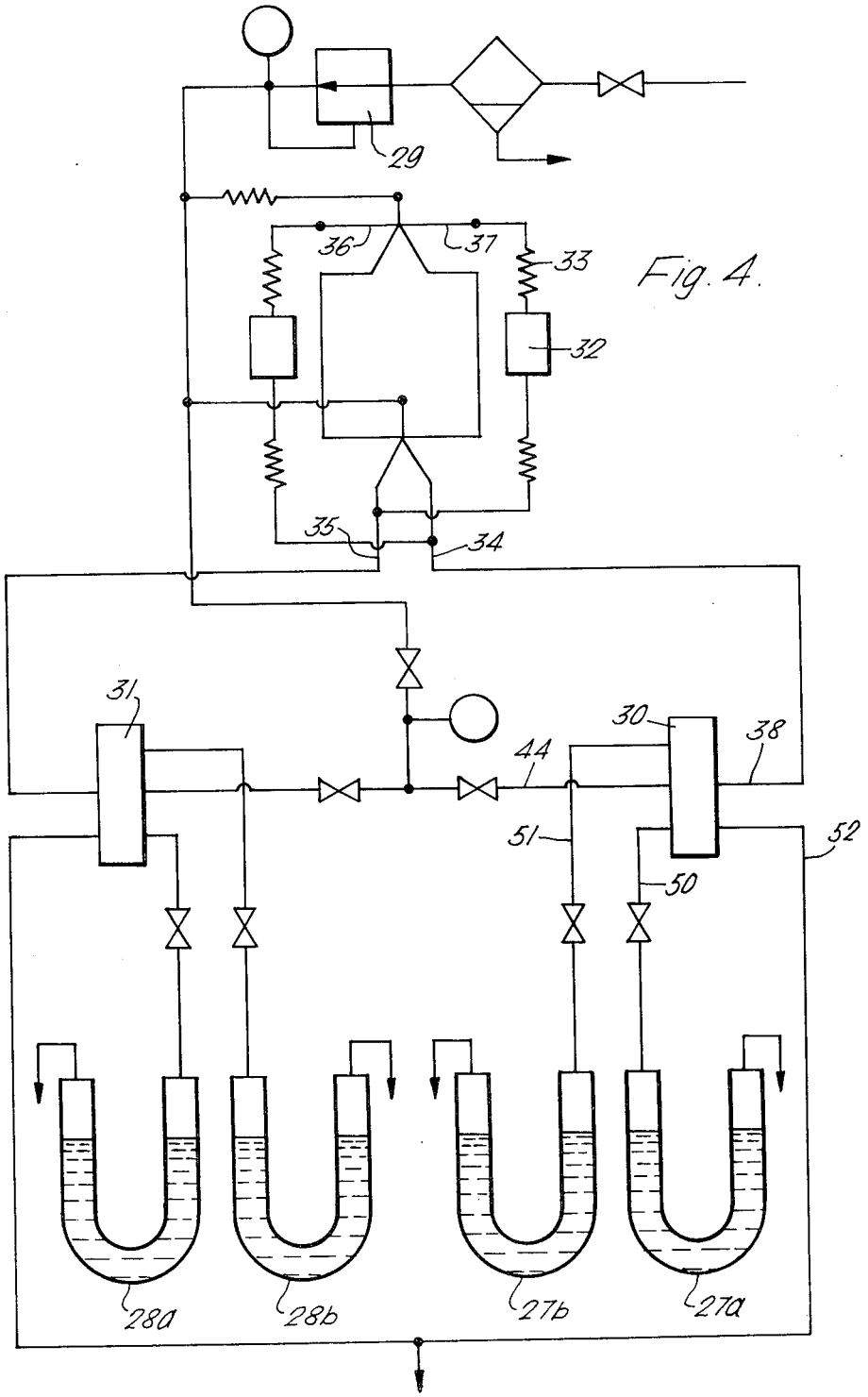
FIG. 4 shows in the form of a circuit diagram a specific application of pressure transformers in accordance with the invention.

In FIG. 4, the purpose of the system therein illustrated is to control the pulsing of liquid in mixer-settler apparatus in which gentle agitation of the contained liquids is produced by induction and expulsion into and from dip tubes, these tubes being connected to manifolds in which alternating suction and delivery is therefore required. These suction and delivery phases are impressed on gaseous medium in the manifolds through the intermediary of barrier liquid in U tubes of which pairs appear in FIG. 4 marked **27*a*, 27*b* and 28*a*, 28*b***. The requirement is that whilst one pair is in the suction phase the other pair should be in the delivery phase.

Basically the control system employs a free running fluidic oscillator energised from a fluid supply maintained at constant pressure, as by a regulator 29, to time the reversals of state of two pressure transformers 30 and 31 by which the same supply produces alternating suction and delivery in anti-phase relationship at the U tube pairs. The oscillator is a two stage bistable amplifier, each stage being a Coanda-type switch with feedback through reservoirs and restrictors such as 32 and 37 from each of the second stage outlets 34 and 35 to control ports 36 and 37 of the first stage. The reservoir/restrictor combination in each feedback line determines the oscillation rate, that is to say, the duration of the period over which the constant pressure fluid supply is applied through either of the outlets 34, 35 to either of the pressure transformers 30, 31 before switching to the other takes place.

Figure 5:
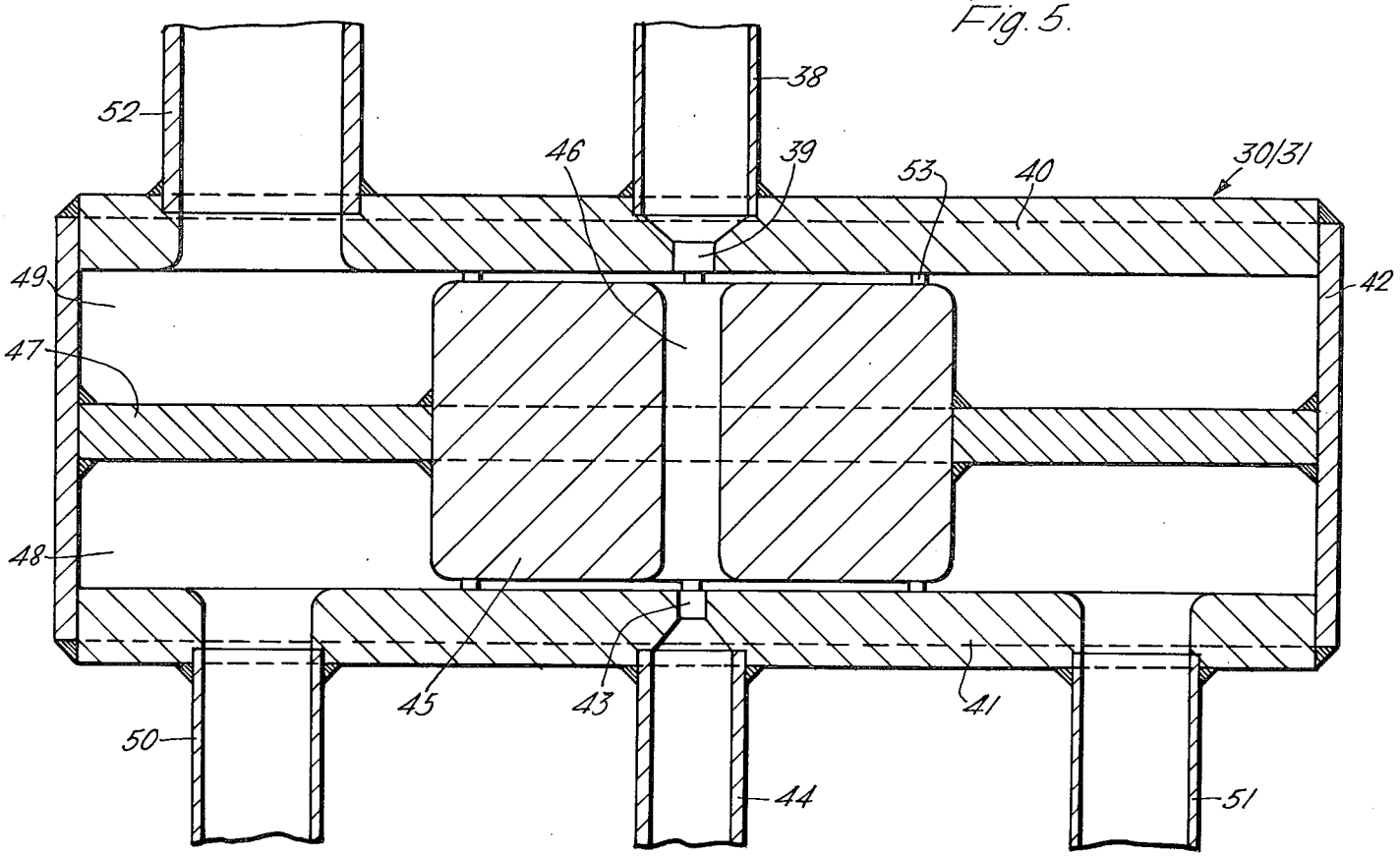
FIG. 5 shows an axial cross-section a pressure transformer for use in this specific application.

For describing the construction of the pressure transformers reference is made also to FIG. 5 where it will be seen that a connection 38 from the oscillator, say from outlet 34, enters axially and through a nozzle 39 into a cylindrical casing made up of end plates 40 and 41 closing off the ends of a short length of large diameter tube 42. Opposing the nozzle 39, and therefore also axially disposed, is a second but somewhat smaller nozzle 43 in the end plate 41, this nozzle being open permanently through a connection 44 to a reduced level of the constant pressure fluid supply. Interposed inside the casing between the nozzles is a centre body 45 which is of solid cylindrical shape except for an axial passage 46 having ends flared by radiussing which acts as a mixer tube. Positioning the centre body is an annular separation plate 47 which also divides the casing interior into two compartments 48 and 49 serving as plenums, that associated with the nozzle 43 being open to the respective U tube pair, say *27a, 27b,* through connections 50 and 51 and the other associated with the nozzle 39 being open to a vent through a single connection 52. On each of the opposite end faces of the centre body is a ring of four pegs, such as 53, protruding equally in all cases so as to space these faces from the adjacent end plate 40, 41 and thereby form radial diffusers opening into the interspace between the respective nozzle 39 or 43 and the axial passage 46.

The constant pressure fluid supply is applied alternately under the control of the oscillator first to the pressure transformer 30 and then to the transformer 31. In the transformer thus supplied, the fluid at constant pressure is formed into a jet which, in opposition to the lower level of pressure maintained at the nozzle 43, proceeds through the axial passage 45 with some entrainment from the vent connection 52 to produce a delivery through the connections 50 and 51 to the associated U tubes. In the other transformer, not for the time being supplied at its nozzle 39, the jet which then proceeds in the opposite direction through the axial passage from the nozzle 43 produces by entrainment a suction at the connections 50 and 51, the combination of jet and entrained flow being discharged largely through the vent connection 52. Thus, in anti-phase relationship, the U tube pairs are subjected to alternating suction and delivery.

It should be noted that all of the illustrated devices are assembled almost entirely from turned components, thereby lending themselves to simple fabrication techniques and consequent cheapness relative to devices requiring more complicated techniques.

I claim:

1. A multi-terminal fluidic flow control device in which two of the terminals communicate respectively with nozzles opposing each other in axial alignment across an interspace characterized in that a third terminal communicates with a radial diffuser opening into and encircling the interspace to receive a substantially continuous power output flow of analog characteristics resulting from interaction of flows in the interspace, the radial diffuser having opposed annular surfaces forming a gap and between which to collect and channel the flow received therein radially to provide at the third terminal the analog output flow which is variable progressively in accordance with variation of the relationship of flows through the nozzles, and the interspace being elongated axially to form a mixer tube between one of the nozzles and the radial diffuser and a fourth terminal, acting as a vent in communication with the mixer tube.

2. A fluidic flow control device as claimed in claim 1 characterized in that the fourth terminal communicates with the mixer tube through a second radial diffuser.

3. A fluidic flow control device as claimed in claim 1 characterized by a second radial diffuser which in like manner as the first mentioned radial diffuser opens into and encircles, but at a different location, the mixer tube and at least one vent so located relative to the radial diffusers that flow into the mixer tube alternately from the nozzles causes suction and delivery phases in anti-phase relationship at terminals communicating respectively with the radial diffusers.

4. A fluidic flow control device as claimed in claim 3 characterized in that the radial diffusers are formed to either side of a partition having a central orifice co-axial with the nozzles, each nozzle having adjacent thereto a vent communication with the mixer tube.

5. A fluidic flow control device as claimed in claim 4 characterized in that a reservoir is interposed between the radial diffusers and into which an inflow to the mixer tube may be supplied for augmentation of the suction and delivery phases.

6. A fluidic flow control device as claimed in claim 1 characterized in that one of the nozzles is larger than the other nozzle.

7. A fluidic flow control device as claimed in claim 1, in which the entry area to the radial diffuser at the inner extremities of the gap is substantially equal to the sum of the areas of the nozzle throats.

* * * * *